US005335863A

United States Patent [19]

DeGrace

[11] Patent Number: 5,335,863

[45] Date of Patent: Aug. 9, 1994

[54] FILTER CARTRIDGE MOUNTING FOR A TOP-FEED FUEL INJECTOR

[75] Inventor: Louis G. DeGrace, Newport News, Va.

[73] Assignee: Siemens Automotive L.P., Auburn Hills, Mich.

[21] Appl. No.: 58,003

[22] Filed: May 3, 1993

[51] Int. Cl.[5] ..... F02M 51/06; F02M 61/16

[52] U.S. Cl. ..... 239/575; 239/585.1; 239/DIG. 23

[58] Field of Search ..... 239/575, 585.1, 585.4, 239/DIG. 23

[56] References Cited

U.S. PATENT DOCUMENTS

| | | | |
|---|---|---|---|
| 1,835,865 | 12/1931 | Hansen | 239/575 X |
| 4,625,919 | 12/1986 | Soma et al. | 239/585.4 |
| 4,717,080 | 1/1988 | Sauer | 239/585.4 X |
| 4,811,905 | 3/1989 | Ishikawa et al. | 239/DIG. 23 X |
| 4,899,937 | 2/1990 | Haruch | 239/575 X |
| 4,946,107 | 8/1990 | Hunt | 239/585.4 |
| 5,165,656 | 11/1992 | Maier et al. | 239/585.4 X |
| 5,263,649 | 11/1993 | Babitzka et al. | 239/585.1 X |

FOREIGN PATENT DOCUMENTS

| | | | |
|---|---|---|---|
| 217249 | 9/1961 | Austria | 239/585.4 |

*Primary Examiner*—Andres Kashnikow
*Assistant Examiner*—William Grant
*Attorney, Agent, or Firm*—George L. Boller; Russel C. Wells

[57] ABSTRACT

A top-feed electrically controlled fuel injector includes a filter cartridge disposed in a fuel inlet tube for filtering particulate material larger than a certain size from the fuel that passes into the interior of the fuel injector. In one embodiment, the filter cartridge is press-fit on a shoulder at an axially outer end of an adjusting tube which is telescopically engaged with the inlet tube and axially fixed thereto after adjustment. The filter cartridge is preferably generally tubular in shape, having an imperforate axially outer end, an inner end fitted onto the adjusting tube, and frame sidewalls supporting a fine mesh screen, such that an annular space through which fuel is constrained to flow is formed between the filter cartridge and the inlet tube, with a well at a closed axially inner end of the annular space for collecting particulate material which has been filtered out of the fuel.

10 Claims, 2 Drawing Sheets

FILTER CARTRIDGE MOUNTING FOR A TOP-FEED FUEL INJECTOR

FIELD OF THE INVENTION

This invention relates generally to electrically operated fuel injectors that inject fuels, such as gasolines and their equivalents, into internal combustion engines. In particular, it relates to fuel injectors of the type commonly referred to as top-feed fuel injectors, and to the mounting of a fuel filter cartridge in this type of fuel injector.

BACKGROUND AND SUMMARY OF THE INVENTION

Calibration of one form of top-feed fuel injector is performed by positioning an adjustment tube within the fuel inlet tube to a position that provides a certain preloading of a spring that is disposed between the axially inner end of the adjustment tube and the fuel injector's armature. It is conventional practice to insert a filter cartridge into the entrance end of the fuel inlet tube after the fuel injector has been assembled and calibrated. The purpose of the filter cartridge is of course to filter any particulate material larger than a certain size from the fuel that passes into the interior of the fuel injector.

A typical filter cartridge is generally tubular in shape, comprising a plastic frame that supports a filter medium in the sidewall of the cartridge. The axially outer end of the frame is a circular ring while the axially inner end is an imperforate circular wall. Several axially extending bars of the frame extend between the circular ring and the circular imperforate wall to form radially facing curved windows in the frame. The filter medium is disposed in these windows, fully covering them. A metal band is fitted around the outside diameter (O.D.) of the circular plastic ring at the axially outer end of the cartridge frame to provide a press-fit diameter for press-fitting of the cartridge to the inside diameter (I.D.) of the inlet tube and to provide for the filter medium to be spaced radially inwardly of the inlet tube's I.D. so that a circular annular space is provided between the filter medium and the inlet tube's I.D. The imperforate circular wall at the axially inner end of the cartridge is spaced from the axially outer end of the adjustment tube. After the filter cartridge has been assembled into the inlet tube, fuel entering the inlet tube is constrained to pass first axially through the plastic ring at the axially outer end of the cartridge into the inside of the cartridge, and then radially outwardly through the filter medium to the circular annular space between the cartridge and the inlet tube's I.D. From there the filtered fuel continues axially through the inlet tube and then into the adjusting tube to continue its passage through the fuel injector.

Ideally, calibration of a fuel injector should be conducted after all assembly operations have been completed. Thus, while in the case of the top-feed fuel injector that has just been described it would be advantageous if calibration could be performed after the filter cartridge has been assembled, the filter cartridge inherently blocks access of calibration equipment to the adjusting tube.

The present invention provides a solution that allows the calibration step to be performed after the filter cartridge has been assembled into the fuel injector. This provides the opportunity for a significant consolidation of calibration and final testing procedures, in particular performing final testing while a fuel injector is in a calibration head. This is helpful in reducing the amount of handling of a fuel injector and increasing the through-put of a final test/calibration system. It also offers the potential for significantly reducing the amount of plant floor space that is required for final test/calibration of mass-produced fuel injectors.

Certain functional attributes are also imparted to a fuel injector by embodying the invention in it. A filter cartridge placed in a fuel injector in accordance with the present invention disposes a closed axial end of the cartridge axially outwardly and an open axial end axially inwardly. Upon entering the fuel inlet tube, fuel does not enter the filter cartridge directly, but rather must first pass through a cylindrical annular space between the cartridge and inlet tube and then must make a right angle turn in order to enter the interior of the cartridge by passing through a filter medium on the sidewall of the cartridge. A well is provided at the axially inner end of this cylindrical annular space for collection of particulate material that is filtered out of the fuel by the cartridge. Filtered fuel exits the cartridge via its open axially inner end, and thus there is no accumulation of particulate material within the interior of the cartridge, as could be the case for the prior fuel injector. It can be fairly said that a fuel injector embodying the present invention offers possibilities for improved filtration efficiency. Moreover, because the axially inner end of the cartridge mounts directly on the axially outer end of the adjusting tube, there is no minimum spacing distance between them, unlike the prior fuel injector wherein the fact that the axially inner end of the cartridge is closed mandates a certain minimum spacing distance between it and the axially outer end of the adjusting tube to allow proper flow area for the fuel to pass to the adjusting tube without restriction.

The foregoing features, advantages, and benefits of the invention, along with additional ones, will be seen in the ensuing description and claims which are accompanied by drawings. The drawings disclose a presently preferred embodiment of the invention according to the best mode contemplated at this time for carrying out the invention.

DESCRIPTION OF THE PREFERRED EMBODIMENT

Figure 1:
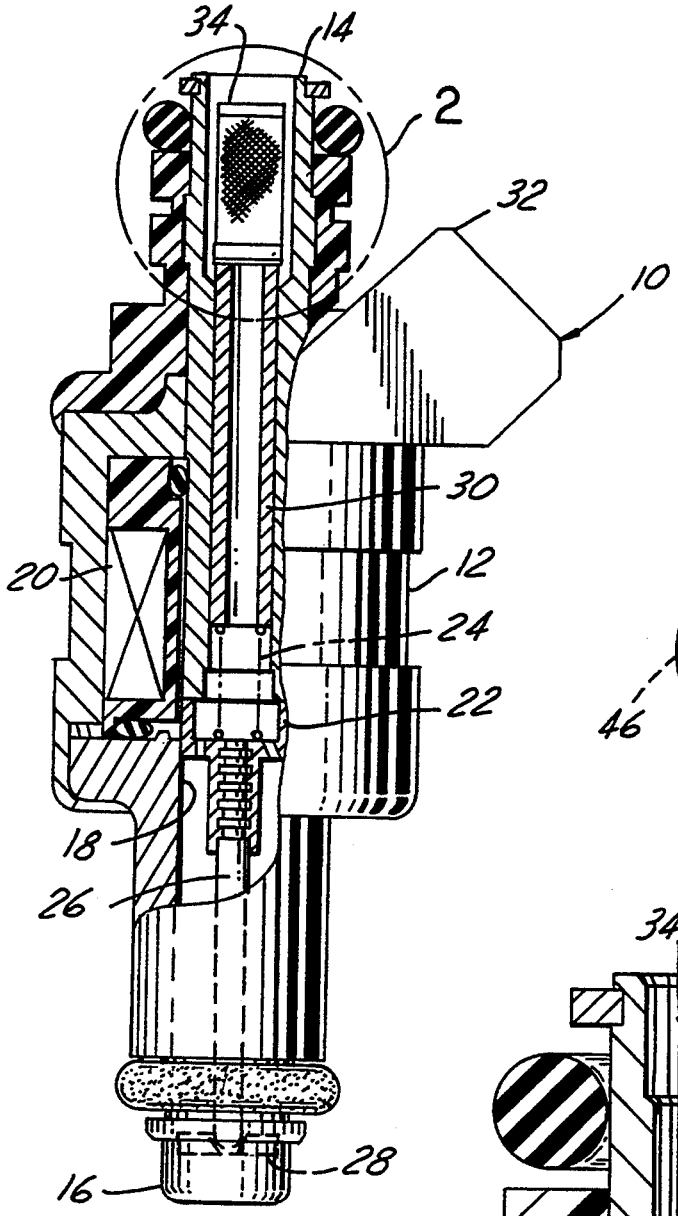
FIG. 1 is a longitudinal view, partly in cross section, of a fuel injector embodying principles of the invention.
Figure 3:
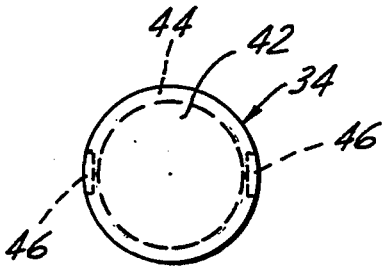
FIG. 3 is a view in the direction of arrow 3 in FIG. 2.
Figure 2:
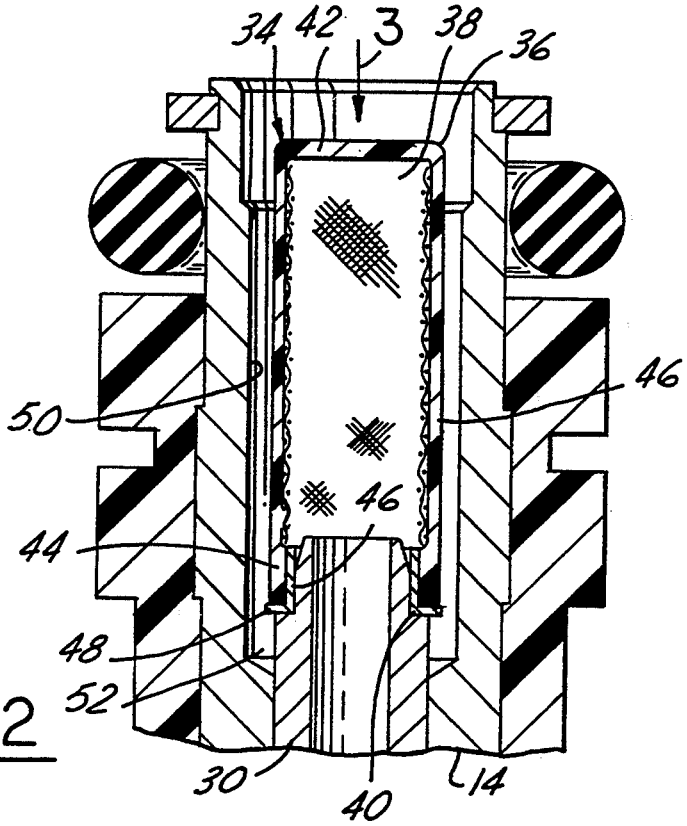
FIG. 2 is an enlarged view in circle 2 of FIG. 1.

The drawings show an exemplary embodiment of top-feed fuel injector 10 in accordance with principles of the invention. It comprises a body 12 having an fuel inlet tube 14 at one axial end and a nozzle 16 at the other axial end. A fuel passage 18 extends internally through the fuel injector from inlet tube 14 to nozzle 16. A solenoid-operated valve mechanism for controlling the fuel flow through passage 18 comprises a solenoid coil 20, an armature 22, and a helical spring 24. Affixed centrally to armature 22 is a needle 26 constituting a valve member that coacts with a valve seat member 28 disposed in passage 18 proximate nozzle 16 to form a valve controlling fuel flow through passage 18.

An adjusting tube 30 is telescopically engaged with inlet tube 14 so that fuel which has entered the entrance of inlet tube 14 will be constrained to pass through adjusting tube 30 as it continues through fuel injector 10. Spring 24 is disposed between the axially inner end of adjusting tube 30 and armature 22 for resiliently biasing the combination of armature 22 and needle 26 toward valve seat member 28 such that the distal tip end of needle 26 seats on a seat of seat member 28 when coil 20 is not being electrically energized, thereby closing the valve so that there is no fuel flow between inlet tube 14 and nozzle 16. When coil 20 is energized, armature 22 is attracted toward the coil against the force of spring 24 thereby lifting needle 26 from valve seat member 28 to open passage 18 so that fuel can flow through the fuel injector and be injected into an engine (not shown) via nozzle 16.

As is conventional, the top of fuel injector 10 is configured for fitting in a sealed manner to a fuel rail socket (not shown), the bottom is configured for fitting in a sealed manner to the engine, and an electrical connector plug 32 provides for coil 20 to be connected to a source of controlled electric current for operating the fuel injector.

The invention relates to a filter cartridge 34 that is disposed at the entrance of inlet tube 14. Filter cartridge 34 comprises a frame 36, a filter medium in the form of a fine mesh screen 38, and a brass ring 40. Frame 36 comprises an imperforate transverse wall 42 at its axially outer end, a circular ring 44 at its axially inner end, and several longitudinally extending bars 46 joining wall 42 and ring 44. Frame 36 may be any conventional material that is suited for use in a fuel handling application, preferably a suitable plastic. The frame thereby defines several curved radially facing windows. Screen 38 is secured to the frame in conventional manner to fully cover these windows. Ring 40 is in the nature of a ferrule that is joined to the frame, fitting onto ring 44 as shown. Ring 40 has an axial wall 46 that fits to the I.D. of ring 44 and a radially outwardly directed flange 48 that overlaps the axial end of ring 44. Ring 40 is made of metal for the purpose of fitting onto the axially outer end of adjusting tube 20.

A shoulder 42 is provided around this axially outer end of adjusting tube 30, and since the adjusting tube is metal, there is a metal-to-metal press-fit of cartridge 34 to inlet tube 14 when the two are coaxially aligned and pressed together. In this way filter cartridge 34 is disposed in covering relation to the entrance of adjusting tube 30 so that it will filter fuel entering the adjusting tube. Since cartridge 34 has a larger O.D. than the nominal O.D. of adjusting tube 30, inlet tube 14 is provided with a counterbore 50 so that a properly sized cylindrical annular space is provided between the sidewall of cartridge 34 and the I.D. of counterbore 50 for handling the fuel flow without significant restriction. The outer axial end of the adjusting tube protrudes beyond the shoulder of counterbore 50 so that an annular well 52 is thus defined between the two tubes 14 and 30 below cartridge 34.

Cartridge 34 is assembled onto adjusting tube 30 during the process of making fuel injector 10. Adjusting tube 30 is inserted into inlet tube 14 during the assembly process, and for calibrating the fuel injector, it is also selectively positioned relative to inlet tube 14 such that a desired preloading of spring 24 is accomplished. The selective positioning is performed by a pushing tool (not shown) that enters fuel injector 10 through inlet tube 14. Since the spring preload is relatively modest, perhaps around two pounds, the axial force exerted on cartridge 34 by the pushing tool can be tolerated by a suitably designed cartridge frame. Once the proper axial positioning of the cartridge-adjusting tube combination has been obtained, the two tubes 14 and 30 are joined by any suitable means such that one tube cannot move axially relative to the other.

When fuel injector 10 is in use, entering fuel passes into the annular space between cartridge 34 and inlet tube 14, from there makes a right angle turn to pass through screen 38 into the cartridge's interior, and from there passes into and through adjusting tube 30. Particulate material greater than a certain size is filtered out by screen 38, and can collect in well 52. Fuel pressure acts in a direction that tends to reinforce the fit of cartridge 34 on adjusting tube 30.

Figure 6:
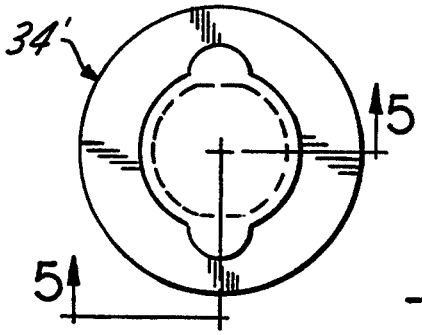
FIG. 6 is a full top view of FIG. 5.
Figure 5:
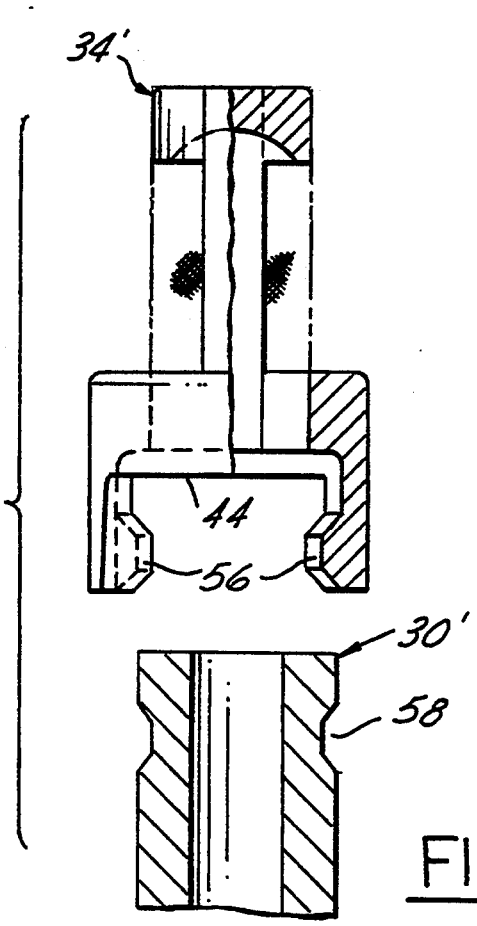
FIG. 5 is a left side view of FIG. 4, but partly in section as taken along line 5—5 in FIG. 6, and further including the top portion of an adjusting tube with which the cartridge is associated, the adjusting tube be shown separated from the cartridge.
Figure 4:
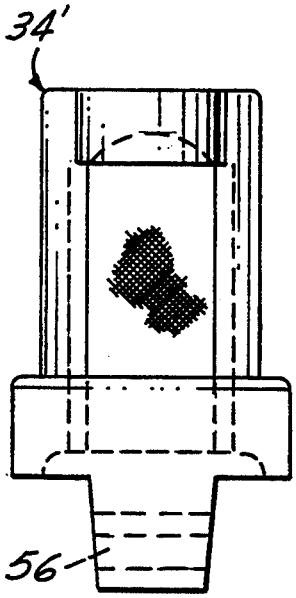
FIG. 4 is a side elevational view of another embodiment of filter cartridge by itself.
Figure 7:
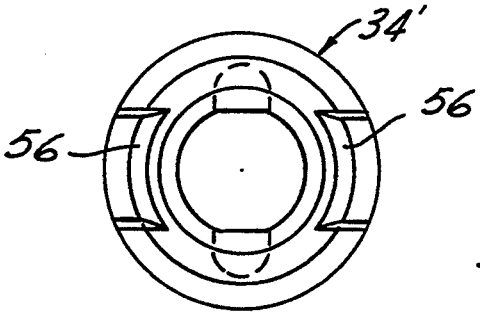
FIG. 7 is a full bottom view of FIG. 5.

FIGS. 4–7 disclose another embodiment of cartridge 34' and and adjusting tube 30'. The cartridge frame has diametrically opposite catches 56 depending from its lower ring 44 for engaging an external groove 58 extending around adjusting tube 30' to provide a snap-on attachment of the cartridge to the adjusting tube. When the cartridge has been snapped onto the adjusting tube, catches 56 force the end of the adjusting tube against ring 44.

While a presently preferred embodiment of the invention has been illustrated and described, it should be appreciated that principles are applicable to other embodiments that are within the scope of the following claims.

What is claimed is:

1. A top-feed fuel injector comprising a body having at one axial end a fuel inlet tube through an entrance of which fuel is introduced into a fuel passage that extends through said body to a nozzle at an opposite axial end of said body, an adjusting tube that is telescopically engaged and joined with said inlet tube such that said adjusting tube is axially fixed with respect to said inlet tube after adjustment, and fuel passing from said inlet tube entrance to said fuel passage is constrained to flow through said adjusting tube, an electrically controlled valve mechanism that controls the flow of fuel through said fuel passage, said mechanism comprising armature means, including a valve member, that is resiliently biased by a spring disposed between said armature means and an axially inner end of said adjusting tube such that said valve member is resiliently biased closed against a valve seat to close said fuel passage to flow when said valve mechanism is not being electrically operated and that unseats from said valve seat to open said fuel passage to flow when said valve mechanism is being electrically operated, and a filter cartridge disposed at the entrance of said inlet tube for filtering particulate material larger than a certain size from fuel that is to pass through the fuel injector, characterized in that said filter cartridge is mounted on an axially outer end of said adjusting tube in filtering relation to fuel flow through said adjusting tube.

2. A fuel injector as set forth in claim 1 characterized further in that said axially outer end of said adjusting tube comprises a shoulder, and said cartridge fits onto said shoulder.

3. A fuel injector as set forth in claim 2 characterized further in that said cartridge has a press-fit engagement with said adjusting tube.

4. A fuel injector as set forth in claim 1 characterized further in that said filter cartridge comprises a filter medium supported on a frame.

5. A fuel injector as set forth in claim 1 characterized further in that said filter cartridge is generally tubular in shape having an axially inner end fitted onto said axially outer end of said adjusting tube, an axially outer end, and a sidewall extending between said axially outer and axially inner ends of said filter cartridge, said axially outer end of said filter cartridge is imperforate, and said sidewall of said filter cartridge comprises a filter medium for performing the filtering function.

6. A fuel injector as set forth in claim 5 characterized further in that axially inwardly of said filter medium within said inlet tube there is a well in which material that has been filtered from fuel may collect.

7. A fuel injector as set forth in claim 6 characterized further in that said well is annular and is radially inwardly bounded by said adjusting tube and is radially outwardly bounded by said inlet tube.

8. A fuel injector comprising a body having a tube through an entrance of which fuel is introduced into a fuel passage that extends through said body to a nozzle from which fuel is injected, an electrically controlled valve mechanism that controls the flow of fuel through said fuel passage, and a filter cartridge disposed at the entrance of said tube for filtering certain particular material from fuel that is to pass through the fuel injector, characterized in that said filter cartridge has an axially outer end that comprises a closed transverse wall facing the entering fuel and a sidewall that in cooperation with said tube forms an annular space into which the entering fuel is constrained to flow because of said closed transverse wall, said annular space being closed at an axially inner end thereof, said cartridge comprising a sidewall that includes a filter medium and bounds an open interior of said cartridge, entering fuel being constrained to flow through said filter medium and into the interior of said cartridge because of said annular space being closed at the axially inner end thereof, and said cartridge comprising an opening at an axially inner end thereof through which fuel that has entered the interior of said cartridge passes from said cartridge.

9. A fuel injector as set forth in claim 8 characterized further in that at the closed axially inner end of said annular space there is a well for collecting particulate material that has been filtered out of fuel by said filter medium.

10. A fuel injector as set forth in claim 8 characterized further in that said axially inner end of said cartridge is fitted onto an open axial end of a further tube such that fuel passing from said cartridge through said opening in the axially inner end of the cartridge passes into said further tube.

* * * * *